US012507835B2

(12) United States Patent
Tramontina et al.

(10) Patent No.: US 12,507,835 B2
(45) Date of Patent: Dec. 30, 2025

(54) RESERVOIR ASSEMBLY FOR A LIQUID PRODUCT DISPENSER

(71) Applicant: Kimberly-Clark Worldwide, Inc., Neenah, WI (US)

(72) Inventors: Paul F. Tramontina, Harleysville, PA (US); Charles A. Osborne, Jr., Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 107 days.

(21) Appl. No.: 18/546,608

(22) PCT Filed: Mar. 23, 2021

(86) PCT No.: PCT/US2021/023637
§ 371 (c)(1),
(2) Date: Aug. 16, 2023

(87) PCT Pub. No.: WO2022/203656
PCT Pub. Date: Sep. 29, 2022

(65) Prior Publication Data

US 2024/0130575 A1 Apr. 25, 2024
US 2024/0225374 A9 Jul. 11, 2024

(51) Int. Cl.
*A47K 5/12* (2006.01)

(52) U.S. Cl.
CPC ..... *A47K 5/1217* (2013.01); *A47K 5/1202* (2013.01); *A47K 2005/1218* (2013.01)

(58) Field of Classification Search
CPC ..... A47K 5/1217; A47K 5/1202; A47K 2005/1218; A47K 5/06; A47K 5/12
(Continued)

(56) References Cited

U.S. PATENT DOCUMENTS 4,938,384 A 7/1990 Pilillo et al.
6,929,150 B2 8/2005 Muderlak et al.
(Continued)

FOREIGN PATENT DOCUMENTS

CN 103781721 A 5/2014

OTHER PUBLICATIONS

Arendal et al., Soap Level Monitoring System, Chalmers University of Technology Department of Product and Production Development, http://publications.lib.chalmers.se/records/fulltext/162771.pdf, 2012, 133 pages.
(Continued)

*Primary Examiner* — David J Walczak
(74) *Attorney, Agent, or Firm* — Dority & Manning, P.A.

(57) ABSTRACT

A reservoir assembly for use with a liquid dispenser. The reservoir assembly includes a connecting member housing having a reservoir connecting surface and a switch, wherein the reservoir connecting surface has a first switch contact surface disposed within a first protrusion member. The assembly also includes a container housing that is configured to be removably attached to the connecting member housing. The container housing includes a main container and a connecting member housing surface that includes a second switch contact surface configured in a first weakened region. After contact of the first switch contact surface and the second switch contact surface, the protrusion member is configured to engage the first weakened region such that the first weakened region breaks away from the connecting member housing surface such that first switch contact surface and second switch contact surface are unable to make contact.

20 Claims, 9 Drawing Sheets

(58) Field of Classification Search
USPC ..... 222/32–36
See application file for complete search history.

(56) References Cited

U.S. PATENT DOCUMENTS

| | | | | |
|---|---|---|---|---|
| 8,100,299 | B2 | 1/2012 | Phelps et al. | |
| 8,291,898 | B2 | 10/2012 | Southby et al. | |
| 8,430,271 | B2 | 4/2013 | Poulard | |
| 8,479,950 | B2 * | 7/2013 | Ophardt ..... | A47K 5/1217 250/221 |
| 8,517,019 | B2 | 8/2013 | Brewer et al. | |
| 9,172,266 | B2 | 10/2015 | Curtis et al. | |
| 9,656,032 | B2 | 5/2017 | Lu et al. | |
| 9,687,120 | B2 | 6/2017 | Muderlak et al. | |
| 10,213,063 | B2 | 2/2019 | Wegelin et al. | |
| 10,545,044 | B2 | 1/2020 | Wegel | |
| 2009/0008408 | A1 | 1/2009 | Ophardt et al. | |
| 2009/0204256 | A1 | 8/2009 | Wegel | |

OTHER PUBLICATIONS

PCT Search Report Corresponding to Application No. PCT/US2021/023637 on Mar. 23, 2021.
European Search Report Corresponding to Application No. 21933430.7 on Oct. 25, 2024.
Chinese Search Report Corresponding to Application No. 202180094925.5 on Sep. 24, 2025.

* cited by examiner

RESERVOIR ASSEMBLY FOR A LIQUID PRODUCT DISPENSER

RELATED APPLICATIONS

The present application is the national stage entry of International Patent Application No. PCT/US2021/023637 having a filing date of Mar. 23, 2021, which is incorporated herein in its entirety by reference thereto.

BACKGROUND

A wide variety of liquid dispensers, such as counter-mounted or "in-counter" liquid dispensers, wall-mounted dispensers or stand-alone dispensers, are known in the art. One problem in the art of fluid dispensers is refilling an empty reservoir. For example, in certain dispensing systems that are commercially available, refills are completed by removing an empty reservoir and replacing the empty reservoir with a replacement reservoir which is filled with liquid product. However, often times maintenance personnel will replace reservoirs before they are empty, which can result in product waste. Other times, maintenance personnel may not replace the product reservoir in a timely manner, which causes no product to be available for restroom patrons. Accordingly, there is a need in the art for easier and more convenient ways to refill product dispensers, that results in less product waste and improved patron satisfaction.

SUMMARY

In general, the present disclosure is directed to a reservoir assembly for use with a liquid dispenser. The reservoir assembly includes a connecting member housing having a reservoir connecting surface and a switch, the reservoir connecting surface having a first switch contact surface disposed within a first protrusion member. The reservoir assembly also includes a container housing for holding a quantity of a liquid, the container housing configured to be removably attached to the connecting member housing. The container housing includes a main container and a connecting member housing surface, the connecting member housing surface having a second switch contact surface configured in a first weakened region, wherein after contact of the first switch contact surface and the second switch contact surface, the first weakened region is configured to breakaway such that first switch contact surface and second switch contact surface are unable to make contact.

The reservoir assembly provided is suitable for use with an in-counter mounted liquid product dispenser, wall-mounted liquid product dispenser, or a stand-alone liquid product dispenser.

Also provided is a counter-mounted liquid product dispenser apparatus that includes a fixture assembly mounted to a counter. The fixture assembly includes a dispensing head mounted to the counter, the dispensing head including one or more delivery spouts configured to dispense liquid product to a user. The apparatus also includes a reservoir assembly including a connecting member housing and a container housing. The connecting member housing is secured either directly or indirectly to the dispenser head and includes a reservoir connecting surface and a switch. The reservoir connecting surface includes a first switch contact surface disposed within a first protrusion member. The container housing is removably attached to the connecting member. The container housing includes a main container for holding a quantity of liquid product and a connecting member housing surface. The connecting member housing surface having a second switch contact surface configured in a first weakened region, wherein upon contact of the first switch contact surface and the second switch contact surface, the first weakened region is configured to breakaway such that first switch contact surface and second switch contact surface are unable to make contact. The apparatus also includes a pump device coupled to the connecting member housing. The pump is operative to pump the liquid product through a fluid outlet defined in the connecting member housing surface.

Also provided is a system for monitoring a refill status for a liquid product dispensing apparatus. The system includes a connecting member housing having a reservoir connecting surface, the reservoir connecting surface includes a switch having a first switch contact surface disposed within a protrusion member. The system also includes a container housing for holding a quantity of a liquid product, the container housing configured to be removably attached to the connecting member housing, the container housing includes a main container and a connecting member housing surface, the connecting member housing surface having a second switch contact surface configured in a first weakened region, wherein after contact of the first switch contact surface and the second switch contact surface, the weakened region is configured to breakaway such that first switch contact surface and second switch contact surface are unable to make contact. The system further includes control circuitry and/or one or more sensors operably configured to communicate a dispense count, wherein upon contact of the first switch contact surface and the second switch contact surface the dispense count is set to zero. The system also includes a computing system operably configured to receive and track the dispense count and generate a refill status upon reaching a threshold dispense count.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 7:
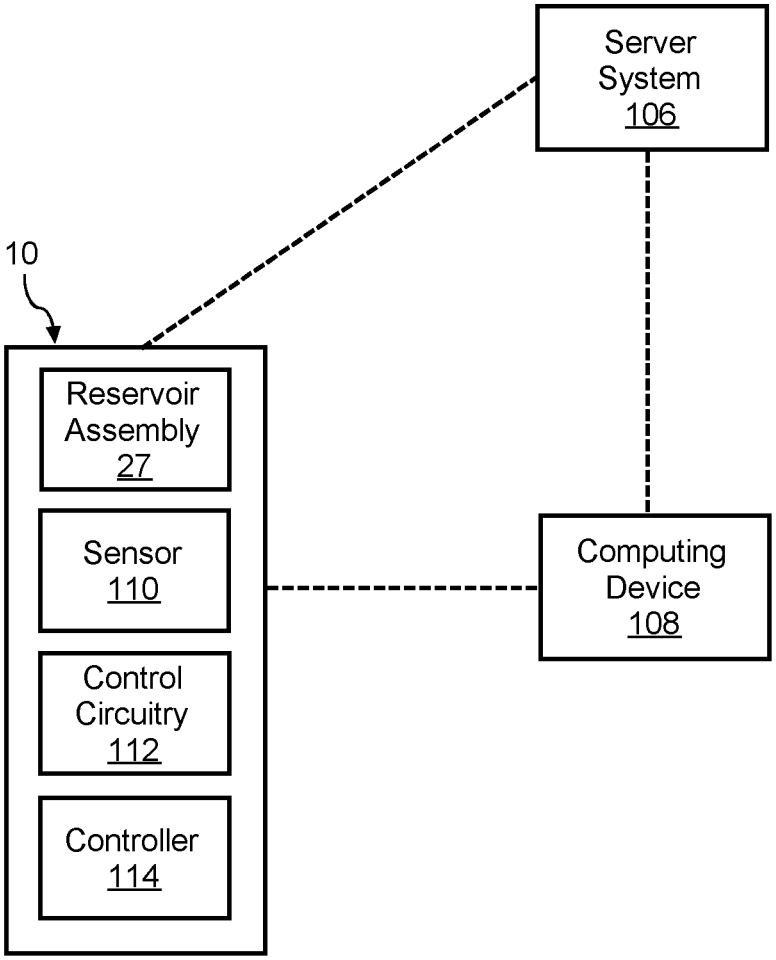
Figure 8:
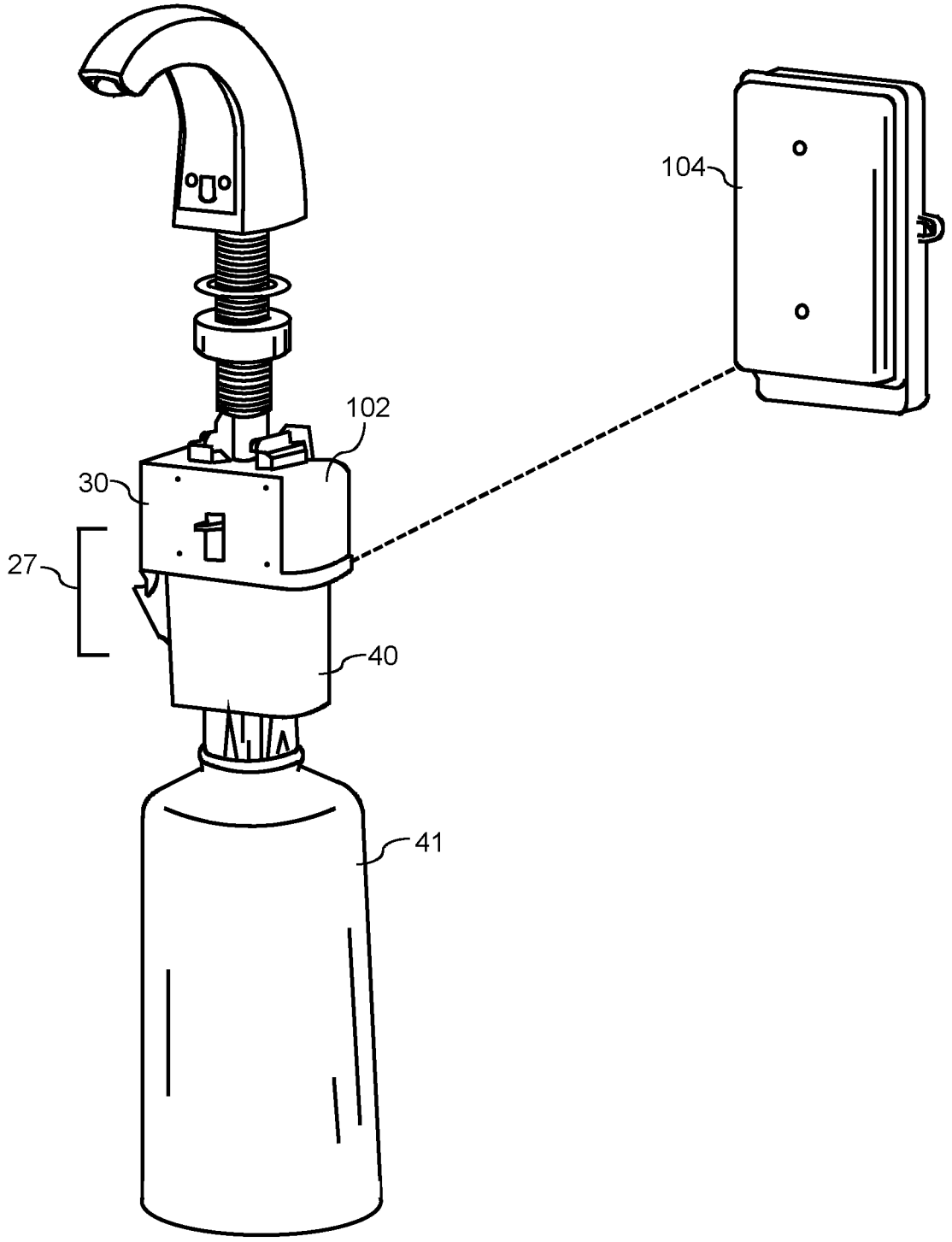

FIG. **6*a*** illustrates a cross section view of portions of the container housing and connecting member housing according to example embodiments of the present disclosure;

FIG. **6*b*** illustrates a cross section view of portions of the container housing and connecting member housing according to example embodiments of the present disclosure;

FIG. 7 illustrates a block diagram of an example network enable dispenser system according to example embodiments of the present disclosure; and FIG. 8 illustrates a counter-mounted viscous liquid dispenser according to example embodiments of the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

Certain systems have been developed to help maintenance staff understand when it is timely to refill product dispenser in their serviced restrooms. For example, one such system utilizes a dispense count system that is capable of monitoring each dispense count to alert maintenance personnel when a low-product amount or low-threshold is realized. Such systems can rely on a switch that is activated once the removable product refill is installed in the product dispenser. For example, installation of a new, full product reservoir and activation of the switch resets the dispense count to zero, such that the dispense count can begin counting down to send an alert in real-time upon a lower threshold limit. However, maintenance personnel often remove the product refill and place the same product reservoir back on the dispenser. When the half-empty product reservoir is placed back in the dispenser system, the switch is triggered indicating that a full refill has been provided, when in fact it has not. This causes the dispense count to re-zero, or to begin counting down from "full", which means that a correct low/empty status will not be effectively determined by the system.

Accordingly, provided herein is a reservoir assembly for use with a liquid dispenser, such as an in-counter mounted liquid dispenser. The reservoir assembly includes a connecting member housing having a reservoir connecting surface, the reservoir connecting surface includes a switch having a first switch contact surface disposed within a protrusion member. The reservoir assembly also includes a container housing for holding a quantity of a liquid, the container housing is configured to be removably attached to the connecting member housing. The container housing includes a main container and a connecting member housing surface. The connecting member housing surface includes a second switch contact surface configured in a first weakened region, wherein after contact of the first switch contact surface and the second switch contact surface, the weakened region is configured to breakaway such that first switch contact surface and second switch contact surface are unable to make contact. Advantageously, the reservoir assembly includes a switch contacting surface in a weakened region that is configured to break away upon initial installation of the reservoir assembly. Therefore, if maintenance personnel removes the container housing, including the liquid product, from the reservoir assembly and places it back on the assembly, the switch will not be activated and the dispense count will not be erroneously set to zero.

The dispenser and dispenser systems disclosed herein are suitable for dispensing a liquid product, such as hand soap, hand sanitizer, and other personal care products. While the term "liquid product" is used, the disclosure is not so limited. Indeed, the product dispensed could be a viscous liquid, such as hand soap, or a foam product, such as foamed hand soap. The disclosure is intended to cover a variety of liquid products that can be dispensed in a viscous or foamed state. Furthermore, while exemplary embodiments described provide an in-counter mounted dispenser, the disclosure is not so limited. Indeed, the reservoir assembly disclosed herein could be incorporated on any number or types of liquid product dispensers where a refill reservoir is necessary. For example, the reservoir assembly provided herein could be utilized on wall-mounted liquid product dispensers and/or stand-along liquid product dispensers.

Figure 1:
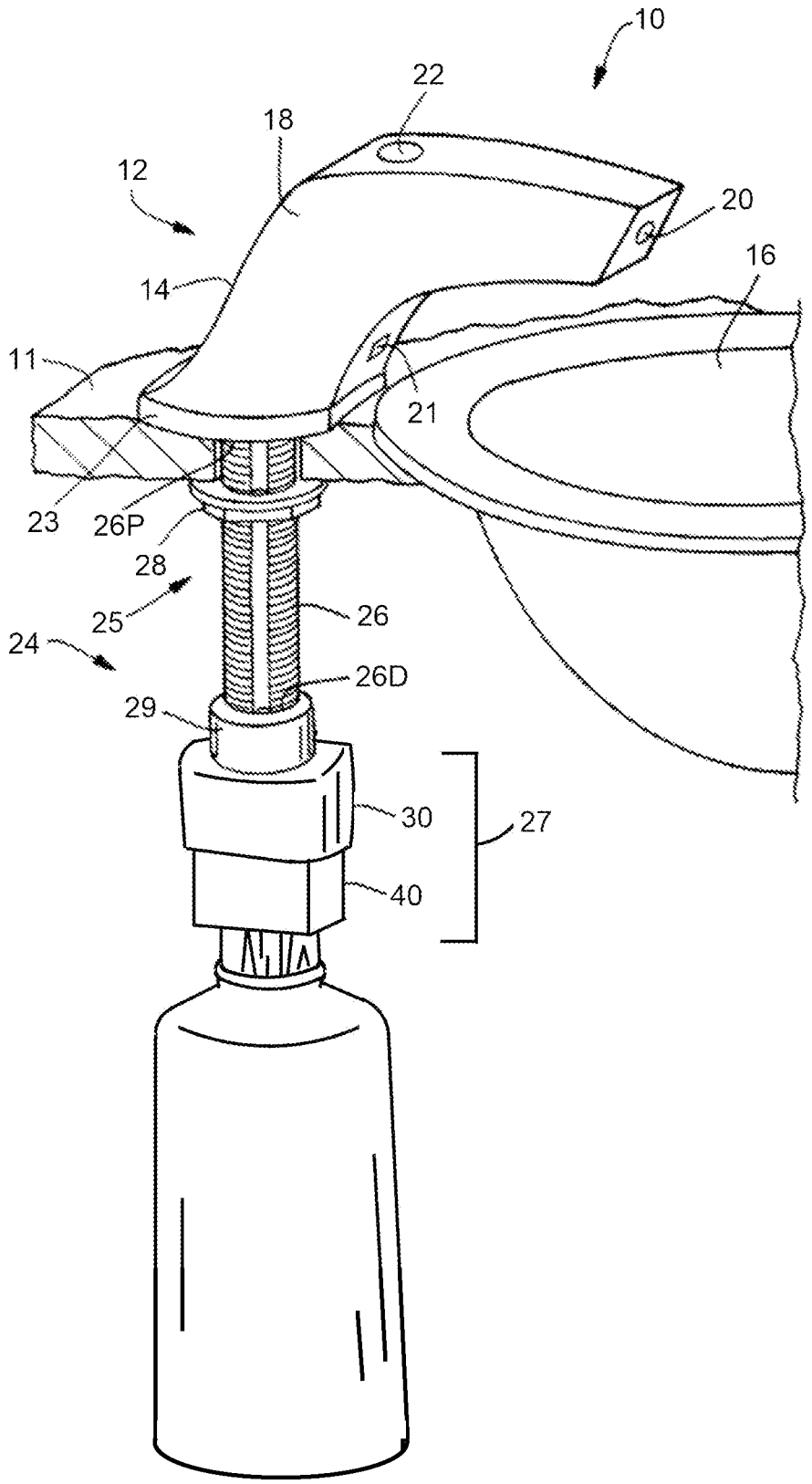
FIG. 1 illustrates a counter-mounted viscous liquid dispenser according to example embodiments of the present disclosure.

FIG. 1 illustrates a dispenser system 10 of the present invention, mounted in a counter 11 in a typical washroom facility. As shown, the dispenser system 10 includes a dispenser fixture 12 having an above-counter portion 14 located adjacent to a sink bowl 16. As shown, above-counter portion 14 includes a dispensing head 18 having a delivery spout 20 extending from the dispensing head 18. Delivery spout 20 is positioned and configured in a conventional manner to supply soap, liquids, or foams to the hand of a user. As shown, the delivery spout 20 is positioned over the sink bowl 16, so that in an event that the liquid product is unintentionally dispensed from the dispensing apparatus, the liquid product will make its way into the sink bowl 16, rather than the counter 11. To dispense the liquid product from the dispenser system, a user presses an actuation button 22, which in turn activates a pump and a quantity (i.e., dose) of the liquid product is delivered to the user's hand. Alternatively, the dispenser system 10 may have an electronic sensor 21, positioned such that the electronic sensor 21 can detect the hands of a user under the delivery spout 20. When the electronic sensor 21 detects the user hand under the delivery spout 20, an electronic means is activated and a quantity of liquid product is delivered to the user's hand. Generally, the actuator button 22 and/or the sensor 21 are electrically connected to a control panel (not shown) having control circuitry which is used to detect a user's hand near under the spout 20, or the user's input to the actuator button 22. In addition, the control circuitry is used to activate the motor and/or a pump device for a given period of time so that the user receives a dose, such as a specific pre-determined amount, of the liquid product. Control circuitry for sensors and actuator buttons is known to those skilled in the art and is shown, for example in U.S. Pat. No. 6,929,150 to Muderlak et al., which is hereby incorporated by reference.

The dispenser fixture 12 includes an under-counter portion 24 having a mounting system 25 securing the dispenser fixture 12 to the counter. The mounting system 25 has an elongated tube 26, which is a generally elongated hollow tube, extending through a hole defined in counter 11. By "hollow", it is intended that a tube has a passage or channel (not shown in FIG. 1) that extends through the elongated tube 26 from proximate end 26P of the elongated tube 26, which is located above the counter 11, to the distal end 26D of the elongated tube 26 located below the counter 11. The elongated tube 26 has a flange 23 on the end of the elongated tube that is positioned above the counter 11. The flange 23 is of a size which is larger than the hole in the counter 11 and the flange 23 serves to keep the elongated tube 26 from falling through the counter 11. As is shown in FIG. 1, the mounting system 25 also has an anchoring mechanism 28 associated with the portion of the elongated tube 26 which extends below the counter 11. The mounting system shown in FIG. 1 is one type of mounting system which may be used in the present invention. It is noted that other types of mounting systems may also be used. The mounting system 25 as shown in FIG. 1 has an elongated tube 26 which is threaded and the anchoring mechanism 28 is a nut threaded onto the threads of the elongated tube 26. Other mounting systems may be used in place of the mounting system 25 shown in FIG. 1.

The under-counter portion 24 includes a reservoir assembly 27 containing a connecting member housing 30 and a container housing 40 for holding a quantity of liquid product. The connecting member housing 30 is located at the distal end 26D of the elongated tube 26. The connecting member housing 30 can be removably connected to the distal end 26D of the elongated tube 26 at a top end 29 of the connecting member 30. One or more delivery tubes can be inserted through the connecting member housing 30 allowing for fluid communication between the delivery head 18 and spout 20 and the connecting member housing 30 and container housing 40. (Not shown). Such configurations are known in the art and can include those described in U.S. Pat. No. 8,100,299 B2 to Phelps et al., which is hereby incorporated by reference.

Figure 2:
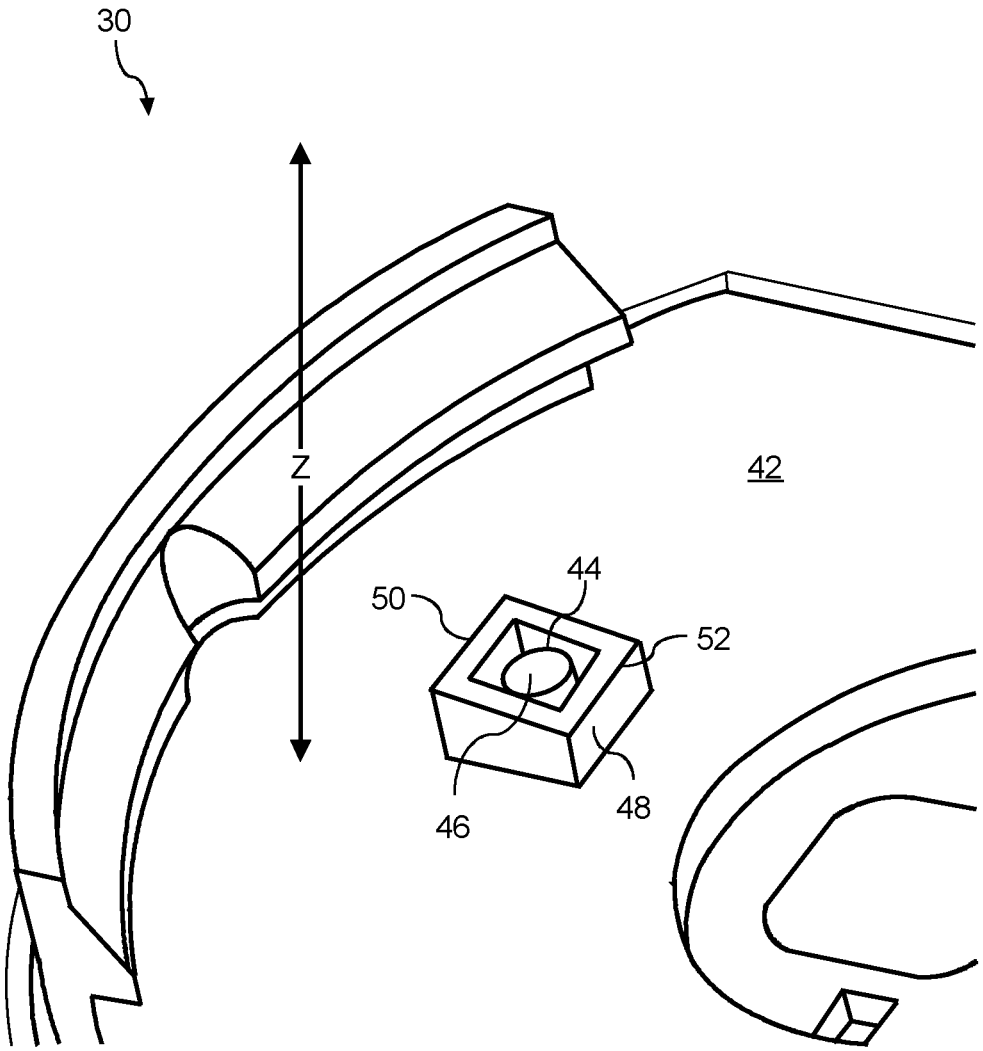
FIG. 2 illustrates a partial perspective view of a connecting member housing according to example embodiments of the present disclosure.
Figure 3:
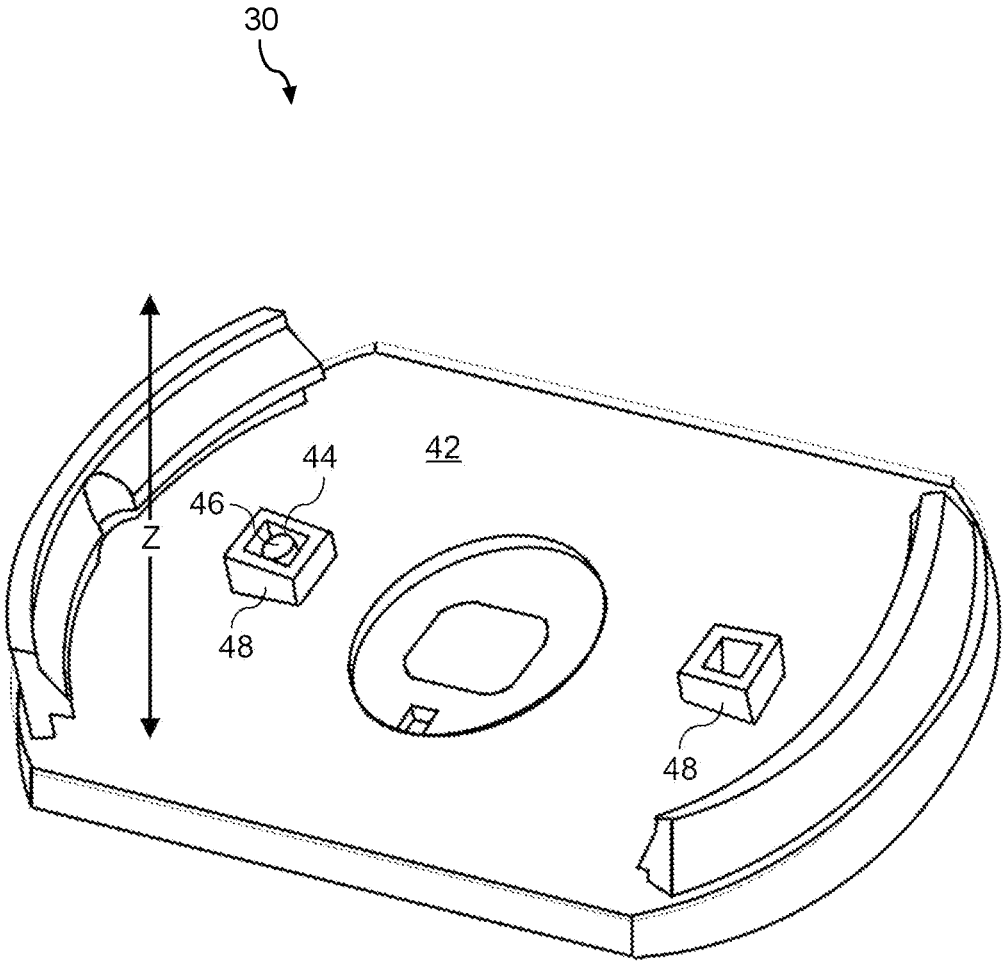
FIG. 3 illustrates a perspective view of a connecting member housing according to example embodiments of the present disclosure.

Referring now to FIGS. 2-3, the connecting member housing 30 includes a reservoir connecting surface 42 including a switch 44 and a switch contact surface 46 disposed within a protrusion member 48. As shown, the protrusion member 48 can be any suitable shape including circular, ovular, rectangular, triangular, etc. The protrusion member 48 can be any shape designed to puncture a surface. For example, as shown at least an outer portion 50 of the protrusion member extends farther in the z-direction that an inner portion 52 of the protrusion member 48. In certain embodiments, the switch contact surface 46 is disposed within the protrusion member 48, such that no portion of the switch contact surface 46 extends beyond the protrusion member 48 in the z-direction. Additional protrusion members 48 not including a switch disposed therein can be located on the reservoir connecting surface 42 (as shown in FIG. 3). For example, where the connecting member housing 30 and container housing 40 are ovular or rectangular in nature, it may be possible to couple them together in various orientations. As such, it may be beneficial to provide at least two protrusion members 48 on the reservoir connecting surface 42 with only one of the at least two protrusion members 48 including switch 44 as will be further described herein.

Figure 4:
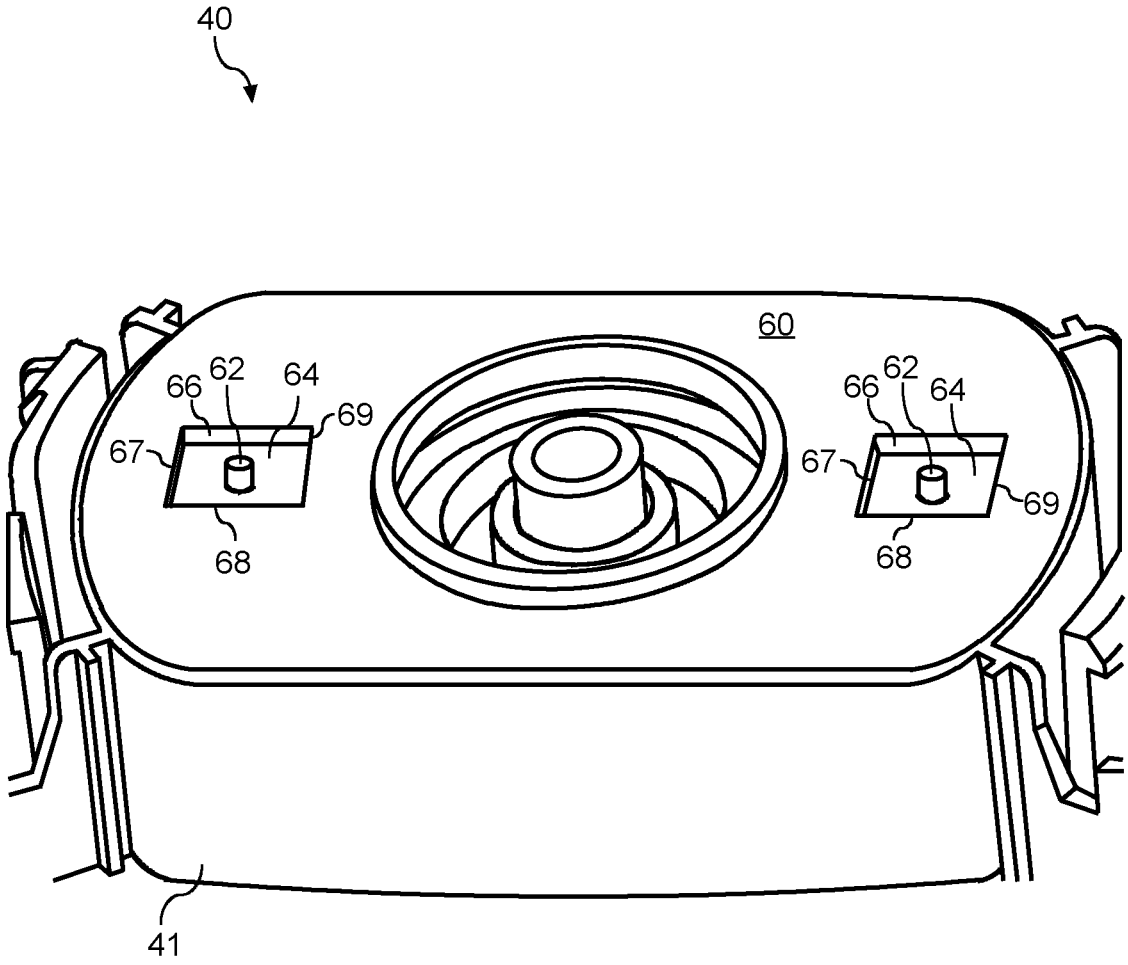
FIG. 4 illustrates a perspective view of a container housing according to example embodiments of the present disclosure.
Figure 5:
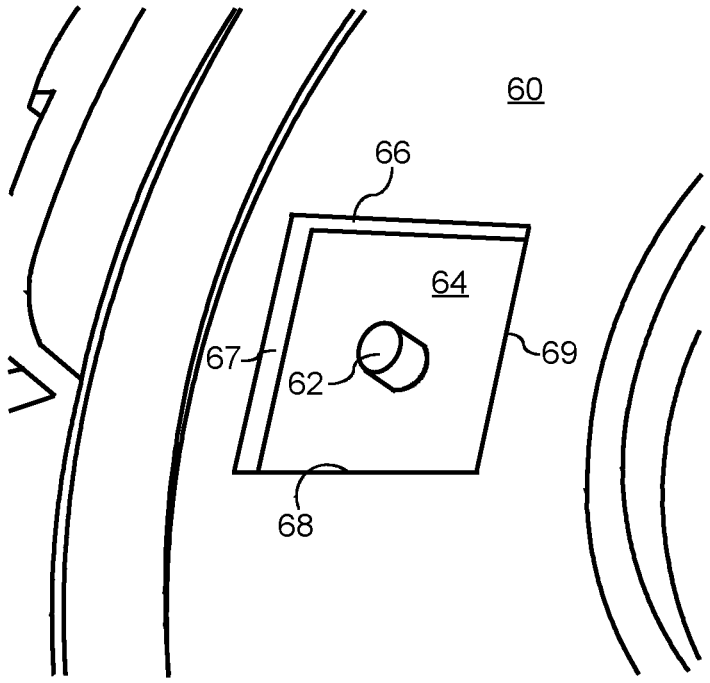
FIG. 5 illustrates a partial perspective view of a container housing according to example embodiments of the present disclosure.

Referring now to FIGS. 4-5, the container housing 40 includes a main container 41 and a connecting member housing surface 60. The main container 41 can be disposed within the container housing 40 and holds a quantity of liquid product. The main container 41 can be in fluid communication with the delivery spout 20 via one or more delivery tubes. (Not shown). The connecting member housing surface 60 includes a switch contact surface 62 configured within a weakened region 64. The weakened region 64 can include a depression or indentation in the connecting member housing surface 60. For example, the weakened region 64 can include a generally square or rectangular depression. The weakened region 64 can include one or more sides 66, 67, 68, 69, including facets or vertices, configured to give or break when exposed to force. For example, force exerted on the weakened region 64 by protrusion member 48 can break one or more of the sides 66, 67, 68, 69, as will be discussed further hereinbelow.

Figure 6A:
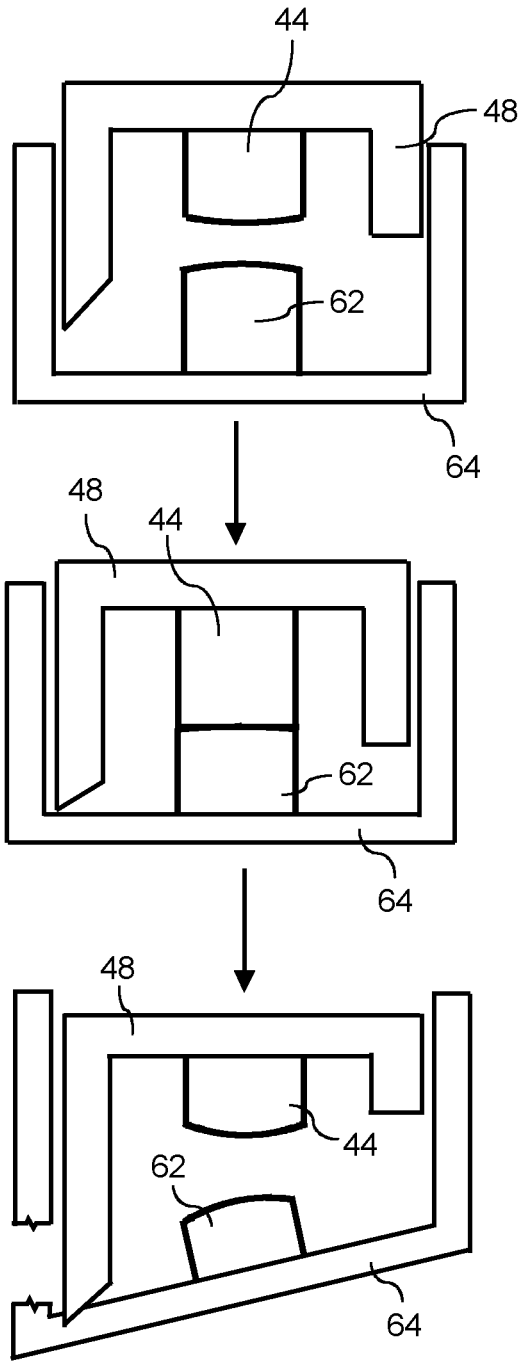
Figure 6B:
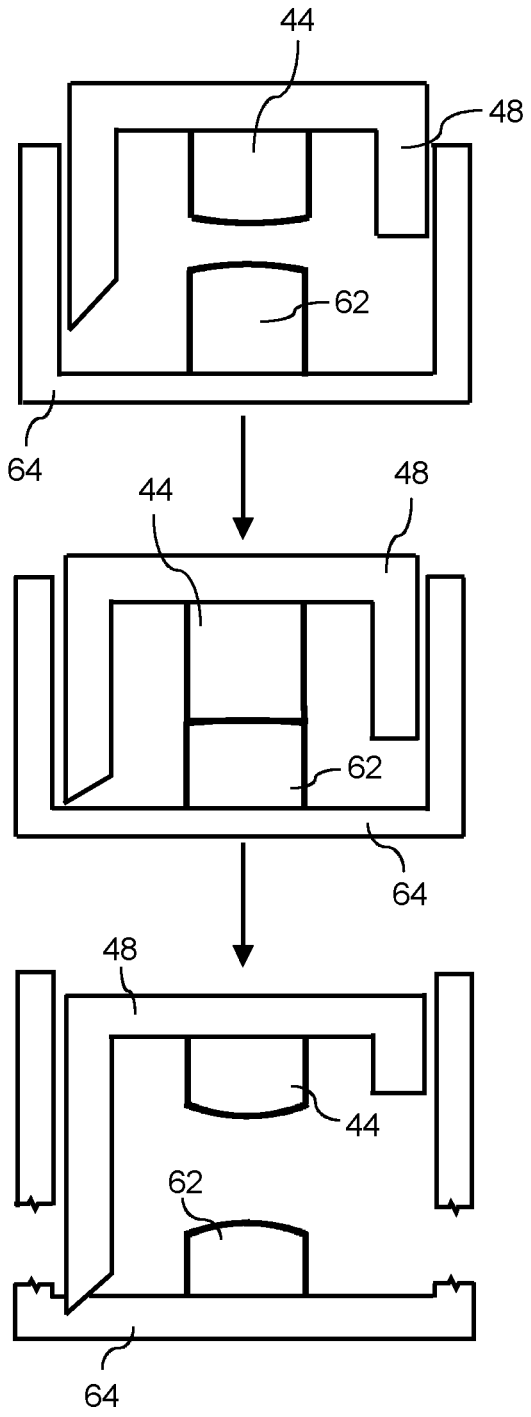

As shown in FIG. 6*a*, in embodiments where the weakened region 64 is rectangular in nature, at least three sides (e.g., 66, 67, 68) of the weakened region 64 can be configured to break, leaving at least one side (e.g., 69) of the weakened region 64 intact. In such an embodiment, the weakened region 64 does not completely dislodge from the connecting member housing surface 60, however, the weakened region 64 is sufficiently dislodged from the connecting member housing surface 60, such that switch contact surface 62 is unable to contact switch contact surface 46. In other embodiments, however, substantially all sides 66, 67, 68, 69 of the weakened region 64 are configured to break when exposed to force as shown in FIG. 6*b*. Such embodiments, allow for the complete dislodgement or causes the weakened region 64, including the switch contact surface 62, to completely break off from the connecting member housing surface 60. The weakened region 64, including the switch contact surface 62 thereon, can fall into the container housing 40, such that switch contact surface 62 is unable to contact switch contact surface 46.

In embodiments, one or more weakened regions 64 and switch contact surfaces 62 can be disposed on the connecting member housing surface 60. As previously discussed, it may be possible to couple the container housing 40 to the connecting member housing 30 in a variety of configurations. As such, more than one weakened regions 64 and switch contact surfaces 62 may be necessary to ensure proper functioning of the dispenser system. For example, in certain embodiments, the number of weakened regions 64 and switch contact surfaces 62 matches the number of protrusion members 48 present on the connecting member housing 30. However, in such embodiments, it is noted that only one switch 44, including switch contact surface 46, is disposed within one of the protrusion members 48. Inclusion of only one switch 44, ensure proper functioning (e.g., reset of the dispense count to zero) of the dispenser system 10 without requiring a specific orientation of the connecting member housing 30 and container housing 40. Furthermore, weakened regions 64, including switch contact surfaces 62, can be oriented or disposed on the connecting member housing surface 60 such that they are in general alignment with the protrusion members 48 located on the reservoir connecting surface 42 of the connecting member housing 30. Generally, the protrusion members 48 and weakened regions 64 should be oriented or disposed such that when the connecting member housing 30 is coupled to the container housing 40, the protrusion member 48 contacts the weakened region 64, thus effectively dislodging the weakened region 64, including the switch contact surface 62, from the connecting member housing surface 60. Furthermore, the protrusion member 48 including the switch 44 and switch contact surface 46 should be oriented or disposed, such that upon initial coupling of the connecting member housing 30 to the container housing 40, switch contact surface 46 is able to make contact with switch contact surface 62, before the protrusion member 48 dislodges the weakened region 64 from the connecting member housing surface 60.

As shown in FIGS. 6*a*-6*b*, when the connecting member housing 30 is coupled to the container housing 40, switch contact surface 46 comes into contact with switch contact surface 62, thus activating switch 44. Activation of the switch 44 is configured to operably set a dispense count to zero. However, after activation of switch 44, protrusion member 48 is configured to break away at least a portion of the weakened region 64, such that switch contact surface 62 is removed from being able to come in contact with switch contact surface 46. For example, once force is applied to the weakened region 64 via the protrusion member 48, the weakened region 64 breaks away from the connecting member housing surface 60, such that subsequent contact between switch contact surface 46 with switch contact surface 62 is not feasible. Such embodiments allow for activation of switch 44 only once.

As previously described, activation of the switch 44 sets a dispense count to zero. As shown in FIG. 7, in certain embodiments, the dispenser system 10 utilizes a dispense count system for accurately tracking use of the liquid product and for alerting maintenance personnel when product remaining in the product reservoir is below a threshold limit (e.g., a low product condition exists). For example, the total quantity of a full product reservoir is known and can be stored on a server system 106 and/or computing system in communication with the dispenser system 10 and additionally or alternatively, one or more computing devices 108. Optionally, in certain embodiments, the dispenser system 10 may be operably in communication with the one or more computing devices 108. The dispenser system 10 of the present disclosure can then be configured to dispense a dose (e.g., a certain quantity of liquid product) each time it is activated. For example, control circuitry 112, can be utilized to generate a dose of liquid product. Each time a dose of liquid product is dispensed, a dispense count is generated and communicated to the server system 106 and/or the computing device 108. For example, in certain embodiments, the connecting member housing 30 or other portion of the dispenser system 10 can include a sensor 110 or other computing mechanism operably configured to communicate each dispense count to the server system 106 or computing device 108. For example, the dispense count can be communicated to the server system 106 and/or computing device 108 via control circuitry 112 or sensor 110 located on or within the dispenser system 10. The server system 106 or computing device 108 can then track the dispense count for a particular dispenser system 10. Once a specific number of dispense counts is reached, the server system 106 and/or computing device 108 can generate an alert that the dispenser system 10 has reached a low quantity and needs to be refilled. In embodiments, the server system 106 can generate the alert and send it to one or more computing devices 108. The computing device 108 can include any number of peripheral mobile devices, including smartphones and tablets. The specific number of dispense counts allowed before a low product status is reached, can be calculated and/or stored on the server system 106 or the computing device 108 and is based on the volume of product initially present in the product reservoir and the dose amount.

Advantageously, the present dispenser system 10 is configured with reservoir assembly 27 such that the dispense count is set to zero, only once, that is, upon initial installation of container housing 40 having a full product reservoir to connecting member housing 30. Accordingly, should maintenance staff remove the container housing 40 to inspect it and replace the same container housing 40 on the connecting member housing 30, switch contact surfaces 46 and 64 are unable to make contact, thus, the dispense count continues and is not erroneously reset to zero.

Furthermore, in some embodiments, in addition to the control circuitry 112, the dispenser system 10 can include a controller 114. The controller 114 and/or control circuitry 112 can control and monitor all the functions of the dispenser system 10 including dose amount of product being dispensed, product usage, and any other activities that are occurring within the dispenser system 10. The controller 114 can be configured to communicate information regarding the dispenser system 10 to a server system 106 and/or computing device 108 via wired means or through a wireless web-based system. Communication from the controller 114, control circuitry 112, sensors 110, etc. can be accomplished through wired-connections or wireless connections, (e.g., Bluetooth Low Energy (BLE) protocol). Wireless communications between components of the dispenser system 10 can also be established via other wireless protocol, such as by cellular communications.

Other operational components, according to those known in the art for use in dispenser systems, can be utilized herein. For example, the dispenser system 10 can include a pump device operative to pump the liquid for dispensing to a user. (Not shown). The pump device can be included in either the connecting member housing 30 or the reservoir housing 40. In certain embodiment, the pump device is disposed within the connecting member housing 30 and is operative to pump the liquid product through a fluid outlet defined in the connecting member housing surface 60.

In various embodiments of the dispensing system provided, the connecting member housing 30 is connected to a motor housing 102 and a power supply housing 104. (See FIG. 8). Alternatively, the motor housing 102 is integral with the connecting member 30, meaning that the motor housing 102 and connecting member 30 are a single unit. Typically, the power supply 104 may be separated from the motor housing so that the power supply may be replaced when needed. That is, the power supply is disconnectable and reconnectable to the motor housing 102. To ensure that power is transferable from the power supply 104 to the motor housing 102, electrical contact points may be used on both the motor housing 102 and power supply 104, such that the electrical contact points are in complementary positions, meaning that when power supply is attached to the motor housing 102 an electrical connection is made. Configurations for motor housings and supply housings are known and are shown, for example in U.S. Pat. No. 8,100,299 to Phelps et al., which is hereby incorporated by reference.

In other embodiments, the motor and/or pumps included to operate the dispenser system 10 may be powered by batteries contained in a battery compartment or can be powered by an AC distribution system. If the dispenser system 10 includes batteries, a sensor can also be included for determining the power level of the batteries.

Also provided herein is a system for monitoring a refill status for a product dispenser. The system can include any of the components of the dispenser system as described herein. In a particular embodiments, the refill monitoring system includes a connecting member housing having a reservoir connecting surface, the reservoir connecting surface including a switch having a first switch contact surface disposed within a protrusion member; a container housing for holding a quantity of a liquid product, the container housing configured to be removably attached to the connecting member housing, the container housing includes a main container and a connecting member housing surface, the connecting member housing surface having a second switch contact surface configured in a first weakened region, wherein after contact of the first switch contact surface and the second switch contact surface, the weakened region is configured to breakaway such that first switch contact surface and second switch contact surface are unable to make contact; and control circuitry and/or one or more sensors operably configured to communicate a dispense count to a computing system, wherein upon contact of the first switch contact surface and the second switch contact surface the dispense count is set to zero. The control circuitry and/or sensors can then be configured to generate and communicate a dispense count to one or more computing or server systems, upon each dose of product dispensed.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A reservoir assembly for use with a liquid dispenser comprising:

a connecting member housing having a reservoir connecting surface and a switch, the reservoir connecting surface having a first switch contact surface disposed within a first protrusion member; and a container housing for holding a quantity of a liquid, the container housing configured to be removably attached to the connecting member housing, the container housing comprising a main container and a connecting member housing surface, the connecting member housing surface having a second switch contact surface configured in a first weakened region, wherein after contact of the first switch contact surface and the second switch contact surface, the protrusion member is configured to engage the first weakened region such that the first weakened region breaks away from the connecting member housing surface such that first switch contact surface and second switch contact surface are unable to make contact.

2. The reservoir assembly of claim 1, wherein upon contact of the first switch contact surface and the second switch contact surface, a dispense count is set to zero.

3. The reservoir assembly of claim 1, wherein the connecting member housing comprises control circuitry and/or one or more sensors operably configured to communicate a dispense count to a computing system.

4. The reservoir assembly of claim 1, wherein a portion of the first protrusion member engaging the first weakened region extends farther in a z-direction than the first switch contact surface.

5. The reservoir assembly of claim 1, wherein the second switch contact surface extends farther in a z-direction than a portion of the first weakened region engaging the first protrusion member.

6. The reservoir assembly of claim 1, wherein the first weakened region is configured such that the first weakened region is not completely dislodged from the connecting member housing surface.

7. The reservoir assembly of claim 1, wherein the first weakened region is configured such that the first weakened region is completely dislodged from the connecting member housing surface.

8. The reservoir assembly of claim 1, wherein the connecting member housing is secured either directly or indirectly to a dispensing head disposed above a counter.

9. The reservoir assembly of claim 1, wherein the connecting member housing comprises a pump device operative to pump the liquid through a fluid outlet defined in the connecting member housing surface.

10. The reservoir assembly of claim 1, wherein the reservoir connecting surface comprises a second protrusion member configured to contact a second weakened region having a third switch contact surface on the connecting member housing surface, wherein the second weakened region is configured to breakaway when contacted by the second protrusion member.

11. A counter-mounted liquid product dispensing apparatus comprising:

a fixture assembly mounted to a counter comprising:

a dispensing head mounted to the counter, the dispensing head having one or more delivery spouts configured to dispense liquid product to a user;

a reservoir assembly comprising:

a connecting member housing secured either directly or indirectly to the dispenser head, the connecting member housing having a reservoir connecting surface and a switch, the reservoir connecting surface including a first switch contact surface disposed within a first protrusion member;

a container housing configured to be removably attached to the connecting member, the container housing comprising a main container for holding a quantity of a liquid product and a connecting member housing surface, the connecting member housing surface having a second switch contact surface configured in a first weakened region, wherein upon contact of the first switch contact surface and the second switch contact surface, the protrusion member is configured to engage the first weakened region such that the first weakened region breaks away from the connecting member housing surface such that first switch contact surface and second switch contact surface are unable to make contact; and a pump device coupled to the connecting member housing, the pump device operative to pump the liquid product through a fluid outlet defined in the connecting member housing surface.

12. The apparatus of claim 11, wherein the connecting member housing comprises control circuitry and/or one or more sensors operably configured to communicate a dispense count to a computing system.

13. The apparatus of claim 11, wherein upon contact of the first switch contact surface and the second switch contact surface, a dispense count is set to zero.

14. The apparatus of claim 11, wherein a portion of the first protrusion member engaging the first weakened region extends farther in a z-direction than the first switch contact surface.

15. The apparatus of claim 11, wherein the second switch contact surface extends farther in a z-direction than a portion of the first weakened region engaging the protrusion member.

16. The apparatus of claim 11, wherein the first weakened region is configured such that the first weakened region is not completely dislodged from the connecting member housing surface.

17. The apparatus of claim 11, wherein the first weakened region is configured such that the first weakened region is completely dislodged from the connecting member housing surface.

18. The apparatus of claim 11, wherein the reservoir connecting surface comprises a second protrusion member configured to contact a second weakened region having a third switch contact surface on the connecting member housing surface, wherein the second weakened region is configured to breakaway when contacted by the second protrusion member.

19. The apparatus of claim 11, comprising an elongated tube, wherein a distal end of the elongated tube is removably connected to the connecting member housing, and a top end of the connecting member housing is connected either directly or indirectly to the dispenser head.

20. A system for monitoring a refill status for a liquid product dispensing apparatus, the system comprising:

a connecting member housing having a reservoir connecting surface, the reservoir connecting surface including a switch having a first switch contact surface disposed within a protrusion member;

a container housing for holding a quantity of a liquid product, the container housing configured to be removably attached to the connecting member housing, the container housing comprising a main container and a connecting member housing surface, the connecting member housing surface having a second switch contact surface configured in a first weakened region, wherein after contact of the first switch contact surface and the second switch contact surface, the protrusion member is configured to engage the first weakened region such that the first weakened region breaks away from the connecting member housing surface such that first switch contact surface and second switch contact surface are unable to make contact;

control circuitry and/or one or more sensors operably configured to communicate a dispense count, wherein upon contact of the first switch contact surface and the second switch contact surface the dispense count is set to zero; and a computing system operably configured to receive and track the dispense count and generate a refill status upon reaching a threshold dispense count.

* * * * *